US008371969B2

(12) United States Patent
Berton et al.

(10) Patent No.: US 8,371,969 B2
(45) Date of Patent: Feb. 12, 2013

(54) TABLE TENNIS RACKET

(75) Inventors: Daniel Berton, Orcet (FR); Adam Jara, Clermont-Ferrand (FR); Olivier Muhlhoff, Chateaugay (FR)

(73) Assignees: Michelin Recherche et Technique S.A., Granges-Paccot (CH); Compagnie Generale des Etablissements Michelin, Clermont-Ferrand (FR)

( * ) Notice: Subject to any disclaimer, the term of this patent is extended or adjusted under 35 U.S.C. 154(b) by 0 days.

(21) Appl. No.: 13/141,074

(22) PCT Filed: Dec. 16, 2009

(86) PCT No.: PCT/EP2009/009045

§ 371 (c)(1),
(2), (4) Date: Sep. 14, 2011

(87) PCT Pub. No.: WO2010/069560

PCT Pub. Date: Jun. 24, 2010

(65) Prior Publication Data

US 2011/0319207 A1 Dec. 29, 2011

(30) Foreign Application Priority Data

Dec. 19, 2008 (FR) ..... 08 58813

(51) Int. Cl.
*A63B 59/04* (2006.01)

(52) U.S. Cl. ..... 473/530; 473/527; 473/528; 473/529

(58) Field of Classification Search ..... 473/527–530
See application file for complete search history.

(56) References Cited

U.S. PATENT DOCUMENTS 2,293,312 A * 8/1942 Sewell ..... 473/529
(Continued)

FOREIGN PATENT DOCUMENTS

CN 2 442 706 8/2001
DE 199 52 138 5/2001
(Continued)

OTHER PUBLICATIONS

"Tischtennis"—News, Training und Service für Spieler, Trainer und Vereine, Nr. 6, Jun. 2008.

*Primary Examiner* — Raleigh W. Chiu
(74) *Attorney, Agent, or Firm* — Cozen O'Connor

(57) ABSTRACT

A ball-striking sole for a table tennis paddle comprises a flexible coating (118) of elastic material, one face (135) of which is lined with elastically deformable pimples (120) which protrude from said face. The cross section of said pimples is greater in their region (122) of attachment to this coating than in the region close to their opposite end (124) and the side wall (125) of these pimples has a concave curved profile over at least a part of the height of the pimple between these two regions. This sole is used particularly successfully in a table tennis paddle in which the face of said sole (112) lined with pimples (120) is directed towards the inner side of the blade (115) of the paddle such that the free ends (124) of the pimples, the lateral surface of which has a concave curved profile (125), are pressed against a layer (126) of elastic material, secured to the blade, the modulus of elasticity of which is much lower than that of the elastic coating (118) of the sole. The smooth face (115-1) of the sole on the opposite side from the pimples (120) forms the striking surface of the paddle.

14 Claims, 3 Drawing Sheets

U.S. PATENT DOCUMENTS

| | | | | | |
|---|---|---|---|---|---|
| 2,311,546 | A | * | 2/1943 | Hurt | 473/529 |
| 2,328,366 | A | * | 8/1943 | Timmermann | 473/529 |
| D249,733 | S | * | 9/1978 | Zabaldo | D21/731 |
| 2006/0160641 | A1 | * | 7/2006 | Mithieux | 473/527 |
| 2011/0319207 | A1 | * | 12/2011 | Berton et al. | 473/529 |

FOREIGN PATENT DOCUMENTS

| | | | | |
|---|---|---|---|---|
| DE | 10 2006 034 795 | | | 1/2008 |
| EP | 1 683 552 | | | 7/2006 |
| JP | 08215360 | A | * | 8/1996 |
| JP | 2004008714 | A | * | 1/2004 |
| JP | 2004041370 | A | * | 2/2004 |
| JP | 2004089551 | A | * | 3/2004 |
| JP | 2004097556 | A | * | 4/2004 |
| JP | 2004113568 | A | * | 4/2004 |
| JP | 2004244505 | A | * | 9/2004 |
| JP | 2004254808 | A | * | 9/2004 |
| JP | 2004255070 | A | * | 9/2004 |
| JP | 2004305602 | A | * | 11/2004 |
| JP | 2005021474 | A | * | 1/2005 |
| WO | WO 2010069560 | A1 | * | 6/2010 |

* cited by examiner

TABLE TENNIS RACKET

RELATED APPLICATIONS

This is a U.S. national stage under 35 USC §371 of application No. PCT/EP2009/009045, filed on Dec. 16, 2009.

This application claims the priority of French application no. 08/58813 filed Dec. 19, 2008, the entire content of which is hereby incorporated by reference.

FIELD OF THE INVENTION

The present invention relates to table tennis, also known as ping-pong, in particular the paddles used for practising this sport and the coatings of the racket head that strikes the ball.

BACKGROUND OF THE INVENTION

It is known that a table tennis paddle usually comprises a striking head, which is generally flat with a rounded contour, for striking the ball, said striking head being attached to a handle by which the user holds the instrument. Typically, the head comprises a core, known as the blade, formed of a sheet of rigid material, such as wood in top-of-the-range paddles. The blade is covered, on at least one side and generally on both sides, with an elastomeric coating, commonly called a "sole", the entire surface of which is lined with pimples which are formed integrally in the material of the coating and generally have a stem which protrudes transversely from one of the faces of the coating.

According to a conventional embodiment, the face coated with pimples is arranged on the outer side of the blade and makes direct contact with the ball. The pimples which come into contact with the ball flex elastically under the impact and deaden the impact in order to give the player better control when hitting the ball. In addition, these pimples store energy by deforming under impact and impart an additional driving force to the ball being returned as they regain their shape.

According to another embodiment, which is also conventional, but reserved more for top-of-the-range paddles, the pimples of the coating are directed towards the blade. The outer face of the head of the paddle, which is intended to come into contact with the ball, consists of the face of the coating or of the sole opposite the pimples. It has an essentially smooth appearance to the naked eye. Between the face covered with pimples and the rigid sheet forming the blade is inserted a layer of elastic material having a low modulus of elasticity, generally made of elastomer foam, to which the coating is joined by adhesive bonding.

Traditionally, the pimples formed integrally in the material of the coating are cylindrical. The body of the cylindrical pimple is attached to the solid sheet in two different ways. The attachment is either formed by a sharp-angled profile (as seen in section), in which the generator of the cylinder forms an angle of 90° with the planar surface of the coating from which the pimple emanates; or this attachment is carried out by softening this angle by deburring or by way of a small truncated fillet.

Whatever the configuration adopted, the essential function of the pimples is to confer "rebound" on the ball by deforming under the impact in order to help to drive it back. By way of their lateral deformation, they are also involved in improving the lateral interactions between the ball and the paddle and in increasing their tangential grip in order to enable the player to impart spin to the ball and to precisely control the return direction he/she wishes it to have. It can also be seen that the work of the pimples results in long-term wear and fatigue of the material. Furthermore, in the case of powerful forces, buckling phenomena of the wall of the material are observed at certain points on the sole. These phenomena are liable to lead to the formation and propagation of splits in this material, which ultimately reduce the efficiency of the paddle until it is unsuitable for use.

The prior art shows that attempts have been made to improve the performance of paddles by modifying the shape of the pimples. Thus, Japanese Patent Application JP2004113568A illustrates pimples having a truncated conical shape, in which the diameter of the pimple decreases between its plane of attachment to the surface of the coating and its free end. In one embodiment illustrated in said document, the shape is interrupted half way up the pimple, from which point the profile becomes cylindrical as far as thefree end face of the pimple. A pimple having a similar profile is also shown in the drawing of document DE102006034795 A1.

However, tests carried out by the applicant with shapes having a truncated conical attachment profile, which is for example inclined at 45° between the pimple and the planar surface of the coating, show that these arrangements have only limited success in reducing the above mentioned difficulties and improving the durability of the paddle with respect to conventional designs. Furthermore, beyond these deficiencies, there exists a demand on the part of the players, in particular professional sportsmen and -women, for an improvement in performance, in particular in terms of the grip between the face of the paddle and the ball at the moment of impact and until the ball is returned, and also for a decrease or even elimination of the inconsistencies in the behaviour of the paddle which result from the appearance of non-linear phenomena such as buckling of the pimples.

Also cited for the record is utility model CN2442706 (Y), in which perfectly cylindrical pimples have a concave end face intended to modify the point contact of the pimple with the ball. However, this arrangement does not appear to have any effect on the behaviour in terms of flexibility and endurance of the body of the pimple. Document to EP1683552 is directed at a table tennis paddle coating, in which the surface which comes into contact with the ball, rather than having pimples, is lined with adjacent cavities, wherein the properties of flexibility and contact with the ball go in the opposite direction to those which can be found with the aid of pimples.

SUMMARY OF THE INVENTION

Therefore, one object of the present invention is to provide solutions for improving the performance of table tennis paddle soles having pimples, both in actual playing terms and with regard to their durability. It is also directed, according to a second object, to the application of these solutions to a form of paddle design which is especially intended for achieving good performance at the top level of the game.

To this end, according to one aspect of the invention, a sole for the ball-striking surface of a table tennis paddle comprises a flexible coating of elastic material, one face of which is lined with elastically deformable pimples which protrude from said face. This sole is characterized in that the cross section of said pimples is greater in their region of attachment to this coating than in the region close to their opposite end, and in that the lateral surface of these pimples has a concave curved profile over at least a part of the height of the pimple between these two regions.

By virtue of this arrangement, it is observed that while the ball is in contact with the sole, forces are transmitted to the free end of the pimple in a more progressive manner, thereby improving the mechanical performance of the pimples. This arrangement also contributes to the homogenization of the contact pressures of the ball on the surface of the coating. This results in a reduction in the internal tensions generated by these pressures. Such a reduction at the same time causes a reduction in the causes of splitting, in particular in the vicinity of the areas of attachment of the pimples to the elastic coating of the sole. In addition, the distribution of the internal stresses in the body of the pimples is more homogeneous. The increase in compressive stresses on account of their section reducing with increasing distance from the region of attachment occurs in regions further away from their attachment to the surface of the sole, where the deformation of the pimples can take place without encountering any obstacle or inconsistency that causes excess pressure and fatigue.

Tests by the applicants have also demonstrated very favourable behaviour in the performance of such a paddle sole under high stresses, for example with players who are capable of using great power when striking the ball. It has been observed that the appearance of buckling phenomena in the wall of the pimples and, as the case may be, in the wall of the elastic coating is averted or retarded. It is known that these phenomena are caused by a break in local coherence in the deformation of the material. These disruptive deformations affect the regularity of the contact pressures with the ball and disconcert the players, in particular experienced players. They can also cause splits to start developing.

According to an advantageous additional feature of the invention, it can be provided that the region of attachment of each pimple to the surface of the elastic coating does not have any angular points with the surface of the coating. Preferably, the profile of the lateral surface of the pimples may also have no angular points over its entire length. This avoids the creation of regions in which stresses, detrimental with respect to the fatigue of the material and damaging to the regularity of the reactions of the pimples under deformation, are concentrated.

According to another feature, the concave curved form can be extended over the entire height of each pimple as far as close to their free end face. The progressive decrease in the section of the pimples between their end attached to the surface of the coating and their free end face resulting from such a profile leads to a favourable distribution of stresses with regard to regular performance of the paddle and its durability. In this respect, the curved profile can be given a radius of curvature which varies along this profile. It is preferred in this case that the smallest radius of curvature be formed at the region of attachment of the pimple to the planar surface of the coating, and that the radius of curvature increases with distance from the region of attachment as far as a portion of the profile having the greatest radius of curvature at the free end of the pimple.

According to one embodiment, the curved profile can be obtained for example by joining together, preferably without any angular points, a series of two or more circular arcs. According to another embodiment a parabolic curved profile is provided and the tests by the applicants have shown that this form is particularly favourable for obtaining a good compromise of performances for the racket coated with such a sole. Preferably in this case, the profile of the region for joining the pimple to the surface of the elastic coating consists of a half vertex of the parabola which is extended by the part of the parabola, the radius of curvature of which increases towards the free end of the pimple.

Finally, according to a preferred embodiement in the case of a parabolic profile, it is particularly advantageous for the strength and good integrity of the system of pimples to ensure that, in the region of attachment of the pimples to the coating of the sole, the profile of each pimple is attached to the profile of adjacent pimples, forming a continuous curved line without leaving a rectilinear gap or flat part in the sole between the two pimples, thereby forming a continuous rounded profile between each pimple and its neighbour.

According to a very advantageous aspect, it has become clear that in addition to its inherent qualities, the sole according to an embodiment of the invention has a preferred application, characterized by an unexpected synergy of characteristics, in the case where the sole is fitted with the pimples directed towards the inside of the racket. According to this embodiment of a paddle which is well known per se in top-of-the-range applications, in particular for competition, the pimples face towards the blade which forms the core of the paddle, while the other face of the coating of the sole remains essentially smooth, within the limits of gloss authorized by the rules governing the game of table tennis. This smooth face is directed outwards and forms the ball-striking face. The gap between the elastic coating and the material of the blade is occupied by a layer of very elastic material having a low modulus of elasticity compared with that of the elastic coating of the sole. This layer is nowadays, very generally in the form of an elastomer foam and the free ends of the pimple are applied directly and fixed to the foam, typically by adhesive bonding.

Another aspect of the invention is directed to a table tennis paddle comprising a striking head and a handle connected to this head, the striking head having a blade covered on at least one side with a splatform formed from a flexible coating of elastic material, one face of which is lined with elastically deformable pimples which protrude from said face. This paddle is characterized in that the face of said sole that is lined with pimples is, in a manner known per se, directed towards the inner side of the blade such that the free ends of the pimples are pressed against a layer of elastic material, secured to the blade, the modulus of elasticity of which is much lower than that of the elastic coating of the sole. Furthermore, the cross section of said pimples is larger in their region of attachment to the coating than in the region close to their opposite end and the lateral surface of this pimple has a concave curved profile over at least a part of the distance between these two regions.

It is known that paddle structures having pimples directed towards the inside are able to give experienced players better ball control and greater striking power than models having outwardly directed pimples. Specifically, this type of form affords better grip between the ball and the paddle, thereby giving the player a very significant sensation of grip on the ball in order to confer spin or very marked changes in direction thereon. This feature otherwise leads in models of this type that are encountered in the prior art to wear of the sole at the pimples and consequent change in the grip properties of the striking surface of the sole, which may reach inconvenient proportions even during the course of a table tennis match.

However, it has become clear that the platform in accordance with the invention provides much better grip between the paddle and the ball than is the case in models of the known type, this being accompanied by superior striking power. The resistance to wear, in particular in the striking surface, is also much improved, and splitting phenomena are very greatly reduced or retarded, if not eliminated. Indeed, the applicants have observed that, by virtue of the curved shape of the flank of the pimples, the contact pressure of the ball on the paddle on each impact is generally lower and uniform. Instead of passing abruptly from a maximum value behind a pimple to a very low value in those areas where the inner face of the coating is not supported, the contact pressure decreases gradually from the centre of each pimple to its edge. The tensions in the plane of the coating, which result from the gradients of the bearing pressure in the area of contact between the regions supported by the periphery of attachment of the pimples and the unsupported region, are lower. On balance, better ball contact is achieved in the unsupported regions, better distribution of pressures is obtained over the entire contact surface between the ball and the sole and much lower tensions are obtained in the coating.

A natural consequence of this improved distribution of stresses on the impact of the ball against the paddle is a lowering in the contact pressure points and at the same time an improvement in grip. This results in a decrease in slippage between ball and paddle and consequently a decrease in the abrasion of the surface of the latter. Thus, another consequence is an increase in the lifetime with respect to wear. By virtue of the decrease in slippage, the improvement in the grip also helps to increase the kinetic energy storage capacity of the ball in the form of potential energy in the pimples. The energy received and stored is returned more efficiently. The striking power that can be achieved in return is consequently greater than that in the forms of the prior art. The improvement in the grip of the ball by the coating according to the invention thus acquires great significance.

For the reasons explained above, the arrangements provided also lead to a reduction in incipient splits and the propagation thereof. These qualities add to the advantages indicated above regarding the improved resistance to buckling. The better distribution of forces and less rapid wear enable the top-level player to preserve a constant level of performance with his paddle throughout a match.

Of course, the complementary arrangements of the invention, which were presented above with regard to platforms for table tennis paddles, take on their entire value here in the production of a paddle according to this aspect of the invention. This is thus the case, in particular, for the absence of angular points in the region of attachment of each pimple to the surface of the elastic coating and preferably along the entire length of the longitudinal profile of the pimples; for the extension of the concave curved form as far as close to the end face of each pimple; for the progressive reduction in the section of the pimples between their end for attachment to the planar surface of the coating and their free end face; for the continuous change in the radius of curvature of the profile over the entire length of the curved shape; for the arrangement of a smaller radius of curvature at the region of attachment of the pimple to the planar surface of the coating, this radius increasing progressively towards the free end of the pimple; and for the production of the curved profile by joining together a series of two or more circular arcs, preferably with no angular points.

Tests by the applicants have made it possible to determine that a parabolic profile is particularly advantageous for implementing the platform in a paddle having inwardly directed pimples according to the second aspect of the invention. Preferably in this case, the profile of the region of joining the pimple to the surface of the elastic coating is formed by a half vertex of the parabola, which is extended by the part of the parabola of which the radius of curvature increases towards the free end of the pimple.

It is likewise preferred to shape the pimples such that, in the region of attachment to the platform, the profile of each pimple is joined to the profile of the adjacent pimple by a continuous curved line with no rectilinear gap or flat part in a plane that passes through the axes of the two pimples.

With these arrangements, a paddle structure is produced which provides an appreciable improvement in the grip of the ball in contact with the surface of the head, without sacrificing the striking power or the durability of the performance.

BRIEF DESCRIPTION OF THE FIGURES

Further features and advantages of the invention will become apparent from the following description with reference to the appended drawings which show, by way of non-limiting examples, embodiments of the subject of the invention. In these drawings.

DESCRIPTION OF ONE OR MORE EXEMPLARY EMBODIMENTS

Figure 1A:
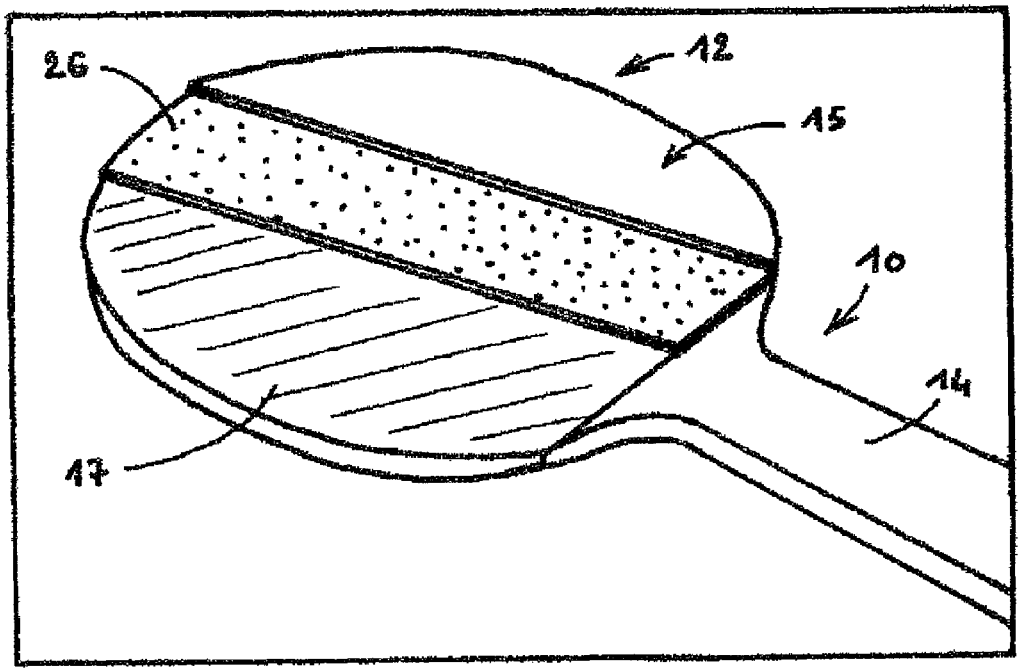
FIG. 1A shows a cutaway view of table tennis paddle of the prior art, the design of which can be adapted particularly well to the implementation of the invention.

FIG. 1A shows a table tennis paddle 10 having in a conventional manner a striking head 12 having a generally rounded form and mounted at the end of a handle 14 which enables a player to hold the paddle in his/her hand so as to manipulate the head 12 in order to confer on a table tennis ball the speed and direction of return with any desired spin.

Figure 1B:
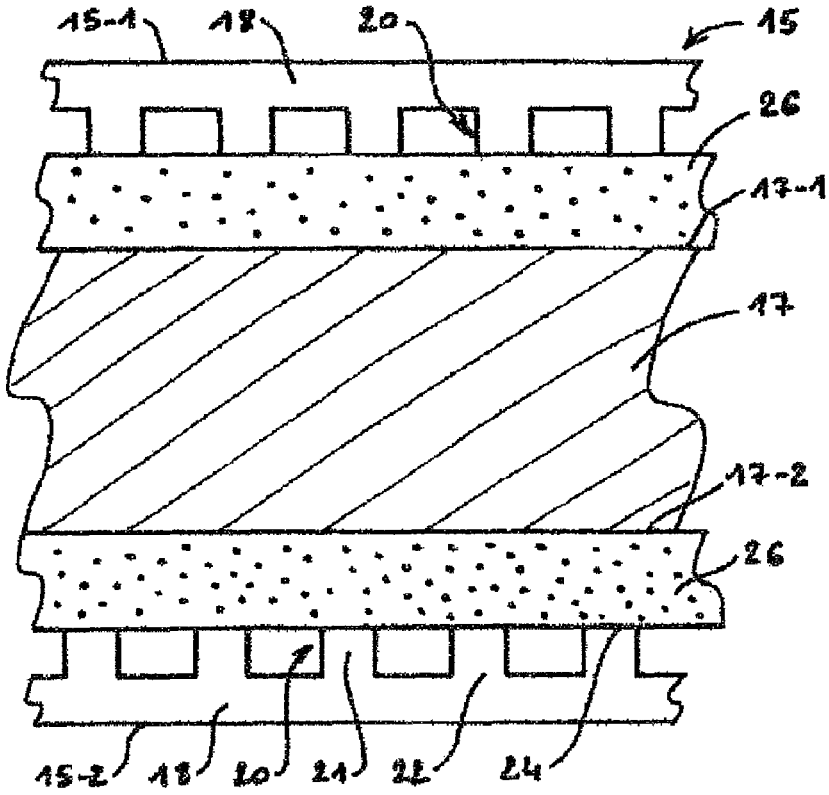
FIG. 1B shows a partial cross section through the thickness of the paddle in FIG. 1A.

The head 12 is a sandwich structure which has a core or blade 17 which is formed in this case from a central rigid sheet of wood. On the outside, the head 12 has on each of its outer faces a sole 15 having a planar face intended to strike the ball. This face has in this case the reference 15-1 for the sole 15 located on one side of the blade. The reference 15-2 designates the striking face of the sole 15 placed on the other side of the blade 17, as is shown in FIG. 1B. Each sole 15 consists of a coating of elastic material 18, the face of which opposite the striking face 15-1, 15-2 is lined all over with pimples 20 which protrude transversely on the inner side of the sole towards the blade 17. In this conventional example of the prior art, each pimple has a cylindrical body 21, one end 22 of which is attached to the planar inner surface of the coating 18 along a joint line, which in this case is circular. The other end 24 of said pimple 20 is free and comes into contact with the upper surface of a layer of elastic foam 26, the opposite or lower surface of which is secured to a face 17-1 of the blade 17. The other face 17-2 of the blade 17 is similarly coated with a layer of elastic foam 26 in contact with the ends of the pimples 20 on one side of the coating 18 of the other sole 15, the smooth face of which opposite the pimples forms the striking face 15-2.

The density and distribution of the pimples are regulated and allow the coating to rest in a flexible manner, but without sagging, against the pimples while in contact with the ball. The layer of foam 26 consists for example of a closed-cell latex. The elastic modulus of rigidity (or modulus of elasticity) of this foam is substantially less than that of the material of the flexible and elastically deformable skin or coating 18.

Figure 2:
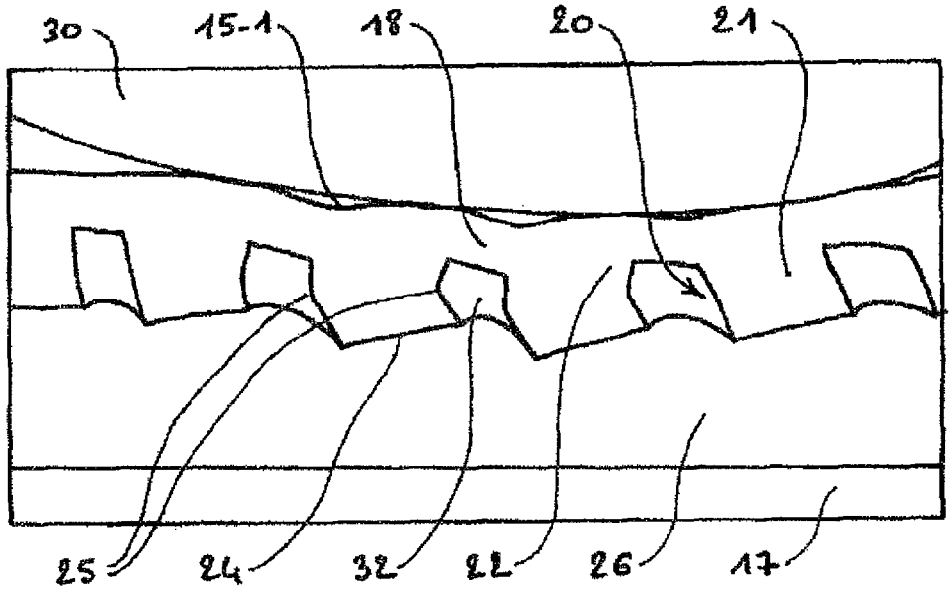
FIG. 2 shows an enlarged cross section in comparison to that in FIG. 1B, showing how the elements of the paddle which are close to its surface act when it hits a table tennis ball with a certain vigour.

FIG. 2 illustrates at high magnification the deformation of the upper face 15-1 of the sole 15 having cylindrical pimples 20, as indicated in FIGS. 1A and 1B, during an impact with a table tennis ball 30 conventionally consisting of a thin shell of celluloid having a diameter of 40 millimeters. It proves that the outer face 15-1 of the coating 18 adopts a curved profile corresponding to the circumference of the ball 30 which communicates with the foam 26. It is also known that the surface of this type of ball is relatively hard compared with the coating of elastomer. It is manufactured respecting the rules of the game of table tennis and also the technical manufacturing possibilities. Its outer surface usually has surface roughnesses which momentarily leave a mark or imprint on the surface of the outer coating 18 of the sole 15 during the impact. The active face 15-1 having a smooth appearance of the coating 18 is itself provided with micro-roughnesses in accordance with a criterion of the game of table tennis which is intended to limit the gloss and to avoid dazzling of the players, which is undesirable. When the ball makes contact with said surface of the coating 18, the micro-unevennesses of this face deform and "engage" with the harder unevennesses of the ball 30. This thus produces dynamic contact having a high grip, which gives an experienced player the possibility of controlling the ball 30 in an effective and precise manner during the return.

FIG. 2 illustrates another phenomenon of the behaviour of the paddle 10 with respect to the ball 30. Specifically, under the violence of the initial impact and the power of the return stroke of the ball, either in a virtually normal direction or with a frictional force generated by a tangential component of the return force, the film of coating 18 resting on the pimples 20 flexes elastically and deforms the latter. Depending on the make-up of the force applied, the deformation produces pure compression along the axis of the pimple or flexion as illustrated clearly in the representation of FIG. 2. It is noted that if the ends 24 of the pimples 20 are in contact with the foam 26 of the elastic layer, the gaps 32 between pimples are not filled with foam. This allows the pimples to deform without encountering much resistance from their environment, either widthwise under the effect of pure compression, or laterally in flexion.

It is clear, on the basis of these observations, that the material of the coating 18 and particularly of the pimples 20 works a great deal during top-level games. The material of the sole is subjected to a series of strong and sudden tensile stresses followed by rapid relaxation upon every impact of the ball, thereby causing fatigue phenomena which lead to splitting. The cylindrical pimples as shown are prone to risks of buckling of the cylindrical wall 25 of the body 21 of the pimples, which lead to a loss of coherence in the structure of the material. These buckling phenomena develop concentrations of stresses in the pimples, these concentrations of stresses being in the immediate vicinity of their joint line with the surface of the sole (see for example, in FIG. 2, the right-hand wall of the flexing pimple bearing the reference 24 at its end, in the region of its angle of attachment to the inner surface of the coating 18). They tend in the long term to cause the opening of splits in the material, these splits then propagating and destroying the integrity. These phenomena also tend to develop waving in the skin of the coating 18 in line with the attachments of the pimples (which can be seen at the point of contact with the ball 30 in FIG. 2). These waves affect the response of the paddle for the player. Finally, slippage of the ball in contact with the sole, which can accompany the sudden increase in local pressure in line with the joint lines of the pimples, leads by abrasion to the formation at the striking surface of the sole of wrinkles of wear which affect the regularity of response of the paddle and tend to impair the performance of the sportsman or sportswoman.

Figure 3:
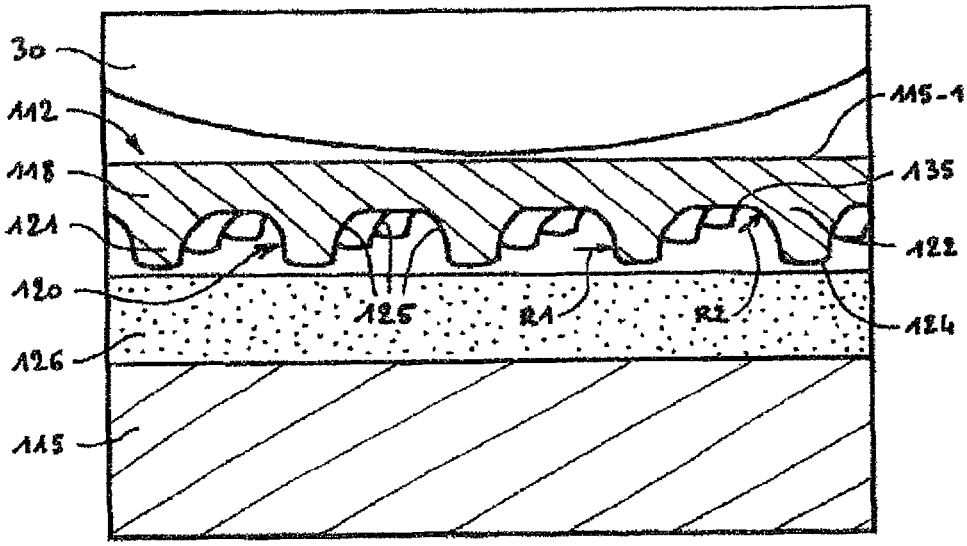
FIG. 3 illustrates a cross-sectional view in which the surface components of the paddle are in accordance with one embodiment of the invention, just before they are deformed by the impact of a table tennis ball.

FIG. 3 shows a structure of the sole according to one embodiment of the invention. The striking head 112 comprises a rigid blade formed by a central sheet 115 covered on each face by a layer of elastic foam having a low modulus 126. An elastic coating 118 having a higher modulus than that of the foam 126 is adhesively bonded to the latter by the end faces of the pimples 120 which line its surface directed towards the support plate 115 and form a sole suitable for striking the ball. The body 121 of each pimple 120 is integrally formed from the material of the coating 118. It is connected to the inner face 135 of the coating 118 at one end 122. The cross section of this end 122 which forms the linking area with the face 135 of the coating 118 is much larger than the section of its opposite free terminal end 124. The longitudinal profile of the wall 125 of the body 121 of the pimple which connects these two ends is made of two circular arcs having radii R1 and R2, with R1, at the end 124, being greater than R2, which connects the lateral wall 125 of the pimple to the lower or inner face 135 of the coating 118. In this example, the concave curved portions of the radii R1 and R2 are contiguous with no angular points. The circular arc of radius R2 merges with the planar lower surface 135 of the flexible coating 118. It can be noted that a flat part exists in this lower surface between the attachment circles of the adjacent pimples 122.

Figure 4:
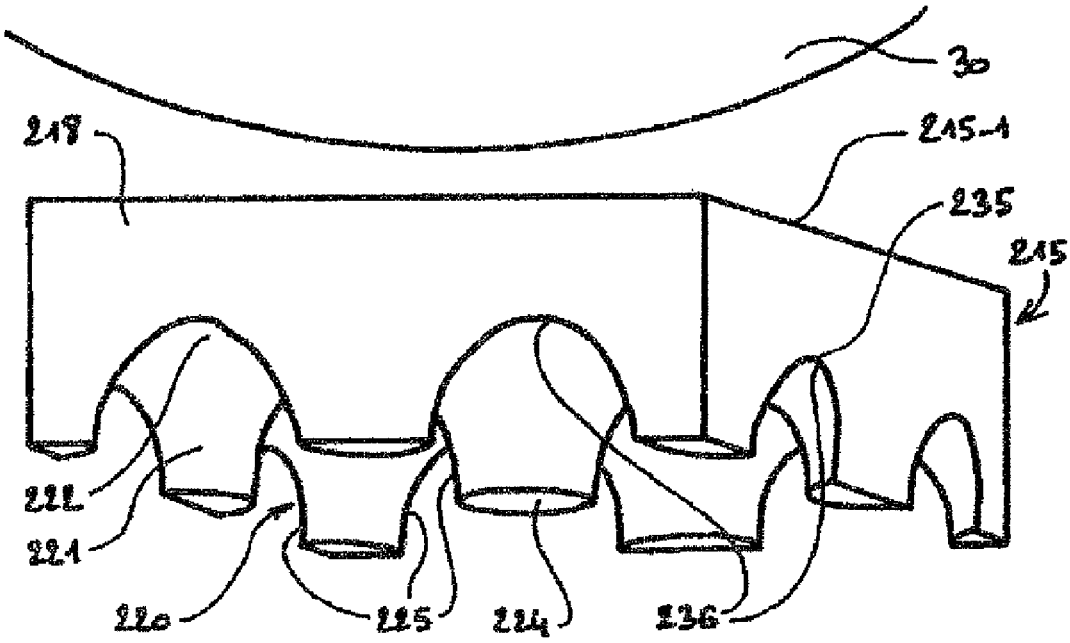
FIG. 4 is perspective bottom view of a paddle sole, in which the face in contact with the ball is smooth and which has pimples in accordance with another embodiment of the invention.

FIG. 4 shows a perspective bottom view of a preferred embodiment of the invention, in particular for a competition paddles, in which the outer elastic coating 218 of one sole 215 on the paddle head having inwardly directed pimples has a smooth outer face 215-1 for contact with the ball 30. Its other face 235 is lined with a network of pimples which protrude on the inner side towards the blade (not shown here), having a profile having parabolic longitudinal section 225. At the attachment to the face 235 of the coating 218, the longitudinal profile of each pimple ends at the vertex 236 of the half parabola which forms this profile. At this point in the surface 235 it is joined without an angular point to the vertex of the half parabola which defines the longitudinal profile of the parabola of the adjacent pimple 220, such that there is no flat part between the joint profiles of the adjacent pimples in the surface 235 in the plane passing through the axes of these pimples. It should be noted here that the term longitudinal profile is used to qualify the form of the section of the wall of a pimple on a plane passing through a longitudinal axis of the pimple.

The tests carried out by the applicants with structures as illustrated in FIGS. 3 and 4 have shown a significant reduction, compared with the prior art, in the contact pressures of the ball in the coating in line with the pimples, and improved contact of the ball with the gaps in the surface of the sole that are not supported by the pimples. It appears that these gaps absorb some of the forces which, in the solutions with cylindrical pimples, are absorbed only by the regions of contact between the end of the pimples and the inner surface of the sole. It appears thus that, by virtue in particular of the curved profile of the region of attachment of the pimples to the inner surface of the sole, homogenization of stresses is produced inside the coating itself and along the pimples.

It has been observed, furthermore, during tests with the structure in FIG. 4 that the parabolic shape of the pimple profile provides excellent resistance to the appearance of buckling phenomena. Without doubt in this regard, it constitutes the best solution with regard to this type of problem.

Furthermore, it has been observed that this embodiment (FIG. 4) gives superior results to those of other configurations with regard to the grip of the sole with respect to balls. The consequence thereof is better grip of the ball, an increase in the durability of performance, less fatigue and greatly reduced buckling tendencies.

The applicants conducted tests on the following various embodiments of the pimples and their attachment to the surface of the sole: a) cylindrical pimples having no attachment profile; b) truncated conical attachment at 45°; c) attachment by a rounded profile of small radius (less than 20% of the height of the pimple); d) attachment by a circular arc having a relatively large radius (greater than 40% of the height of the pimple); e) attachment by a profile formed by the joining together of two arcs having different radii of curvature; and f) pimple having a parabolic profile. The grip measurements carried out with a machine for testing the maximum coefficient of grip between the ball and the paddle in each case showed that solutions b) and c) produced only a small increase, or even a negligible increase in the grip with respect to the results obtained with solution a). In contrast, solutions d) to f) all produced an appreciable increase in grip, solution f) being characterized by an effectiveness greater than that of the two others in all the abovementioned areas.

The invention is not limited to the examples described and shown, and various modifications can be made thereto without departing from the scope defined in the appended claims.

The invention claimed is:

1. A ball-striking sole for a table tennis paddle, comprising a flexible coating of elastic material, one face of which is lined with elastically deformable pimples which protrude from said face, wherein the cross section of said pimples is greater in their region of attachment to this coating than in the region close to their opposite end, and wherein the side wall of these pimples has a concave curved profile over at least a part of the height of the pimple between these two regions, and comprising a progressive decrease in the section of the pimples from their end attached to the inner surface of the coating to close to their opposite end face.

2. The sole for a table tennis paddle according to claim 1, wherein the region of attachment of each pimple to the surface of the elastic coating does not have any angular points with the surface of the coating from which it emanates.

3. The sole for a table tennis paddle according to claim 1, wherein the profile of the lateral surface of the pimples also has no angular points over its entire length.

4. The sole for a table tennis paddle according to claim 1, wherein the smallest radius of curvature of said pimple profile is formed in the region of attachment of the pimple to the planar surface of the coating, whereas the portion of this profile that has the greatest radius of curvature is formed at the opposite end of the pimple.

5. The sole for a table tennis paddle according to claim 1, wherein the curved portion of said lateral profile of the pimple is parabolic.

6. The sole for a table tennis paddle according to claim 1, wherein the curved profile consists of the joining together of a series of at least two circular arcs.

7. The sole for a table tennis paddle according to claim 1, wherein, in the region of attachment of the pimples to the surface of the elastic coating, the profile of one pimple joins the latter to at least one adjacent pimple, forming a continuous curved line without a rectilinear gap between the two pimples.

8. A table tennis paddle comprising a striking head and a handle connected to this head, the striking head having a blade covered on at least one side with a sole formed from a flexible coating of elastic material, one face of which is lined with elastically deformable pimples which protrude from said face, wherein said sole is in accordance with claim 1 and its face lined with pimples is directed towards the inner side of the blade such that the ends of the pimples opposite their region of attachment to the coating are pressed against a layer of elastic material, secured to the blade, the modulus of elasticity of which is much lower than that of the elastic coating of the sole.

9. The table tennis paddle according to claim 8, wherein the outer surface of the coating of said sole is essentially smooth, and wherein the region of attachment of each pimple to the inner surface of this coating has no angular points.

10. The table tennis paddle according to claim 8, wherein the profile of the longitudinal section of the side wall of the pimples between their point of attachment to the inner surface of said elastic coating and their opposite end likewise has no angular points over its entire length.

11. The table tennis paddle according to claim 8, wherein the curved shape over all or some of the length of the pimples has a radius of curvature which varies along this profile.

12. The table tennis paddle according to claim 8, wherein the curved portion of said lateral profile of the pimple is parabolic.

13. The table tennis paddle according to claim 12, wherein the profile of the region for joining the pimple to the inner surface of the elastic coating is formed by the half vertex of a parabola and wherein it is extended towards the free end of the pimple by the part of the parabola which has an increasing radius of curvature.

14. The table tennis paddle according to claim 8, wherein in the region for attaching the pimples to the inner surface of the coating, the profile of a pimple joins the latter to at least one adjacent pimple, forming a continuous curved line without a rectilinear gap between the two pimples.

* * * * *